US007527586B2

(12) United States Patent
Rummage

(10) Patent No.: US 7,527,586 B2
(45) Date of Patent: May 5, 2009

(54) WINDING CORE FOR FABRICS

(75) Inventor: Tony F. Rummage, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 136 days.

(21) Appl. No.: 11/616,408

(22) Filed: Dec. 27, 2006

(65) Prior Publication Data

US 2008/0156927 A1 Jul. 3, 2008

(51) Int. Cl.
*B31C 1/00* (2006.01)

(52) U.S. Cl. ..... 493/269; 493/272; 493/282; 428/34.3; 242/118.32

(58) Field of Classification Search ..... 242/118.32, 242/118.7, 610; 493/269, 272, 282; 428/34.3; 156/187

See application file for complete search history.

(56) References Cited

U.S. PATENT DOCUMENTS

| | | | | |
|---|---|---|---|---|
| 359,447 | A | | 3/1887 | Keene |
| 1,558,264 | A | | 10/1925 | Hathaway |
| 1,631,043 | A | | 5/1927 | Lucas |
| 1,652,601 | A | | 12/1927 | Blair |
| 2,163,618 | A | | 6/1939 | Muller |
| 2,327,738 | A | | 8/1943 | Perry |
| 2,765,129 | A | | 10/1956 | Dunlap |
| 3,141,631 | A | | 7/1964 | Krebs |
| 3,263,942 | A | | 8/1966 | Elwell |
| 3,323,751 | A | * | 6/1967 | Cunningham et al. .. 242/118.32 |
| 3,455,521 | A | * | 7/1969 | Cunningham et al. .. 242/118.32 |
| 3,544,034 | A | | 12/1970 | Jurney et al. |
| 3,545,494 | A | * | 12/1970 | Cunningham ..... 138/144 |
| 3,555,976 | A | * | 1/1971 | Carter et al. ..... 493/274 |
| 3,746,275 | A | | 7/1973 | Whisnant |
| 3,826,445 | A | | 7/1974 | Le Hardy |
| 4,338,147 | A | * | 7/1982 | Backstrom et al. ..... 156/187 |
| 4,390,144 | A | | 6/1983 | Mueller |
| 4,596,366 | A | | 6/1986 | Dick et al. |
| 4,632,332 | A | | 12/1986 | Newman |
| 5,505,395 | A | * | 4/1996 | Qiu et al. ..... 242/118.32 |
| 6,061,876 | A | | 5/2000 | Rowe |
| 6,666,806 | B2 | * | 12/2003 | Kaprelian et al. ..... 492/56 |
| 7,188,800 | B2 | * | 3/2007 | Bessems et al. ..... 242/613 |
| 2005/0202945 | A1 | | 9/2005 | Leung |

* cited by examiner

*Primary Examiner*—Sang Kim
(74) *Attorney, Agent, or Firm*—Alston & Bird LLP

(57) ABSTRACT

A winding core for nonwoven fabrics and the like comprises a wound paperboard tube comprising a plurality of paperboard layers wound one upon another about an axis of the tube and adhered together, and regions of grit bound in an adhesive binder, the regions being affixed to the outer surface of the tube and being sized and arranged such that the regions collectively occupy a minority of the total surface area of the outer surface, the regions further being arranged such that there are at least two of the regions axially spaced apart along a length of the tube in positions to simultaneously encounter and snag an end of a fabric web to be wound about the core. In one embodiment, a narrow sandpaper strip is helically wound about and affixed to the tube to form the regions of grit.

14 Claims, 1 Drawing Sheet

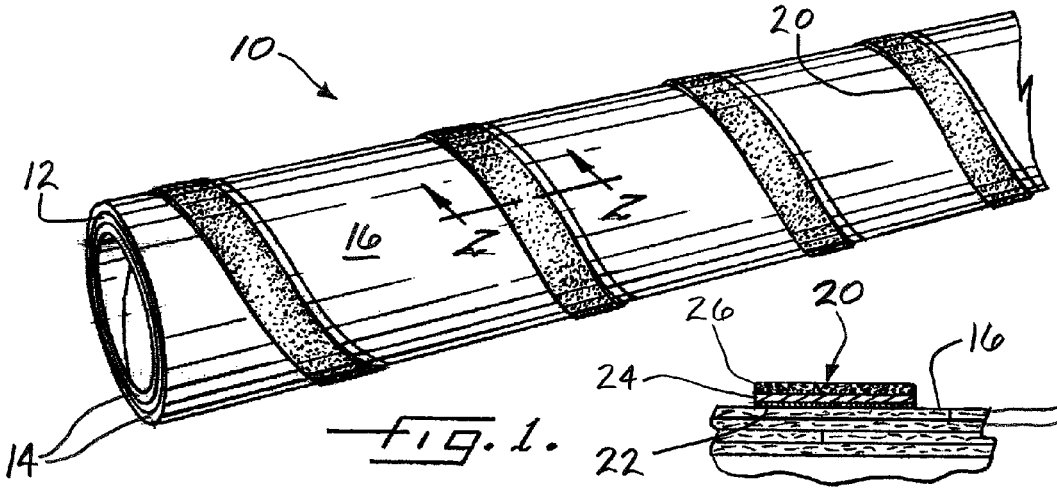
Fig. 1.
Fig. 2.
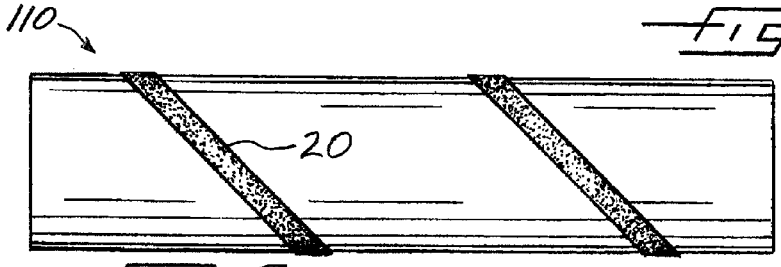
Fig. 3.
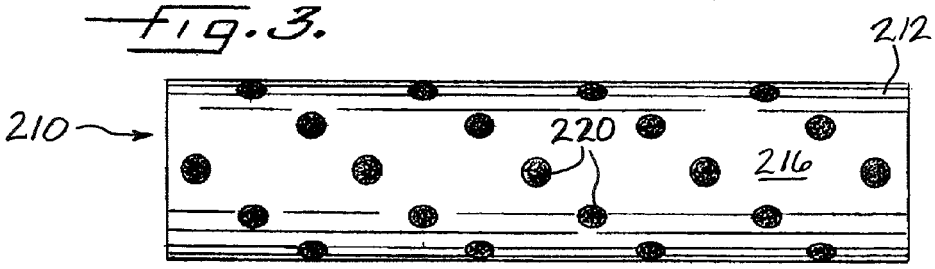
Fig. 4.
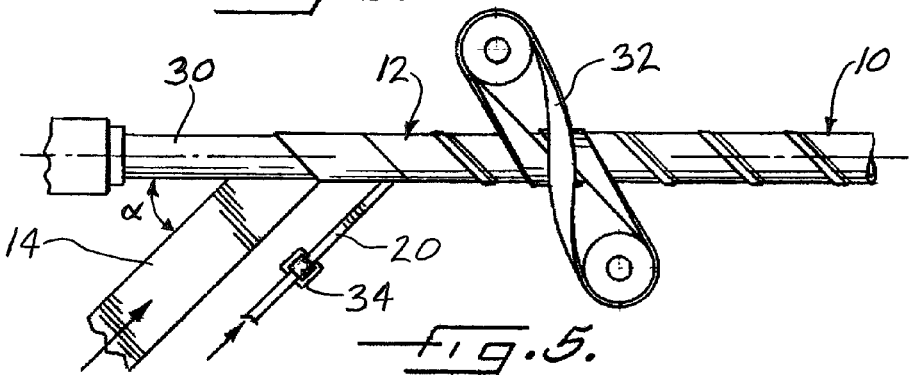
Fig. 5.

WINDING CORE FOR FABRICS

BACKGROUND OF THE INVENTION

The present disclosure relates to winding cores for fabrics such as nonwoven fabric.

Conventionally, nonwoven fabrics have been wound about paperboard winding cores that have an outer embossed surface that is designed to help prevent the fabric from slipping relative to the core. The embossed core is not as effective as desired in terms of its reliability in grabbing the nonwoven fabric to start the fabric winding about the core.

Another type of core that has been tried for nonwoven fabrics has an outermost paper strip that has a multitude of perforations formed in such a manner that each perforation is surrounded by a small generally conical or "volcano-shaped" region of the paper that projects radially outwardly, such that the strip defines a prickly surface designed to grab the fabric. The strip extends helically about the core, covering only a portion of the core's outer surface. As with the embossed type of core, this core is not as reliable as desired in start-up.

BRIEF SUMMARY OF THE DISCLOSURE

A winding core for nonwoven fabrics and the like comprises a wound paperboard tube comprising a plurality of paperboard layers wound one upon another about an axis of the tube and adhered together, the tube having a generally cylindrical outer surface having a total surface area, and regions of grit bound in an adhesive binder, the regions being affixed to the outer surface of the tube and being sized and arranged such that the regions collectively occupy a minority of the total surface area of the outer surface, the regions further being arranged such that there are at least two of the regions axially spaced apart along a length of the tube in positions to simultaneously encounter and snag an end of a fabric web to be wound about the core.

In another embodiment, the regions are arranged such that there are at least three of the regions axially spaced apart along the length of the tube are in positions to simultaneously encounter and snag the end of the fabric web. In still another embodiment, the regions are arranged such that there are at least four of the regions axially spaced apart along the length of the tube are in positions to simultaneously encounter and snag the end of the fabric web.

Advantageously, the regions are arranged such that there is at least one axial line extending the length of the tube along the outer surface that intersects at least two of the regions, more particularly at least three of the regions, and still more particularly at least four of the regions.

In one embodiment, the regions comprise a strip extending helically about the outer surface of the tube. In a particular embodiment, the strip is continuous and extends at least two helical turns about the outer surface over the length of the tube.

The strip can be formed by a piece of sandpaper affixed to the outer surface of the tube.

Alternatively, the regions can comprise discrete spots spaced apart on the outer surface of the tube.

BRIEF DESCRIPTION OF THE SEVERAL VIEWS OF THE DRAWING(S)

Having thus described the present disclosure in general terms, reference will now be made to the accompanying drawings, which are not necessarily drawn to scale, and wherein:

FIG. 1 is a perspective view of a winding core in accordance with a first embodiment of the invention;

FIG. 2 is a cross-sectional view along line 2-2 in FIG. 1;

FIG. 3 is a side view of a winding core in accordance with a second embodiment of the invention;

FIG. 4 is a side view of a winding core in accordance with a third embodiment of the invention; and FIG. 5 is a diagrammatic illustration of an apparatus and process for making a winding core in accordance with one embodiment of the invention.

DETAILED DESCRIPTION OF THE DRAWINGS

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

A winding core 10 in accordance with a first embodiment of the invention is shown in FIGS. 1 and 2. The winding core 10 is configured for use as a core about which a long continuous web of fabric such as a nonwoven fabric or the like is wound into a roll. A challenge in winding such a fabric about a core is getting the fabric started winding about the core. An ordinary paperboard tube has an outer surface that is relatively smooth, and the fabric tends to slip relative to the tube as the tube is rotated by the winding equipment. Accordingly, as noted, some winding cores have an outer embossed surface designed to prevent the fabric from slipping on the core. However, the embossed surface frequently is not particularly effective at starting the fabric winding about the core, although it can be helpful in preventing the wound roll from slipping axially along the core.

The winding core 10 is provided as an alternative to the conventional embossed core. The core 10 comprises a paperboard tube 12 formed from a plurality of paperboard layers 14 wound one upon another about an axis of the tube and adhered together by a suitable adhesive. The tube 12 can be a spirally or helically wound tube or a convolutely wound tube, or even a tube formed by the linear draw process. The tube has a generally cylindrical outer surface 16. The inside diameter, wall thickness, and length of the tube 12 can vary depending on the intended application and the requirements of the particular user. Typically the inside diameter can range from about 1 inch to about 6 inches, the wall thickness can range from about 0.100 inch to about 0.600 inch, and the length can range from about 50 inches to about 250 inches.

In the embodiment of FIGS. 1 and 2, a strip 20 of sandpaper is helically wound about the outer surface 16 and is adhered thereto with a suitable adhesive 22 (FIG. 2). The strip 20 comprises a flexible substrate 24 having affixed thereto a layer 26 of grit bound in a suitable adhesive binder, such that the grit is partially exposed at the upper surface of the strip. The substrate 24 can be any suitable flexible material such as paper, or fabric woven from threads of cotton, polyester, or rayon. The grit can be any suitable natural or synthetic mineral, examples of which include but are not limited to garnet, emery (corundum with iron impurities), crocus mineral (natural iron oxide), aluminum oxide, or silicon carbide. The specific grit material used is not of particular importance in the practice of the present invention. The particle size of the grit can be from about 24 grit (708 μm average particle diameter) to about 220 grit (68 μm average particle diameter), more particularly about 30 grit to about 180 grit, and still more particularly about 40 grit to about 150 grit.

The bond or adhesive is applied to the substrate 24 in two layers, each of which serves a different purpose. A first layer of adhesive, typically called the make coat, holds the mineral grit to the substrate. After the make coat and grit have been applied, a second adhesive, referred to as the size coat, is applied. A thin layer of size coat leaves more of the abrasive grit exposed, while a thicker layer of size coat leaves less of the grit exposed. The sandpaper strip 20 can be either an open coat or a closed coat sandpaper. An open coat sandpaper is one in which the grit occupies less than 100% (typically 50% to 70%) of the surface area of the substrate such that there are open spaces between the grit particles. A closed coat sandpaper is one in which the grit occupies substantially 100% of the surface area.

An apparatus and process for making the winding core 10 of FIG. 1 is diagrammatically depicted in FIG. 5. In this example, the tube 12 is made by a spiral winding process, which is well known in the art and thus will be described only briefly. The apparatus includes a cylindrical mandrel 30 typically made of steel or other suitably strong material. The mandrel serves as the form about which the tube 12 is formed. Thus, a plurality of paperboard plies 14 (only one shown in FIG. 5 for clarity of illustration) are each advanced toward the mandrel 30 at a suitable winding angle $\alpha$ that is determined, based on the diameter of the mandrel 30 and the width of the ply 14, so that the ply 14 will be wound about the mandrel in a helical fashion in such a way that the opposite edges of the successive helical turns of the ply either abut (ideally) or have a slight gap (e.g., less than about 0.031 inch) therebetween. It is usually desired to avoid having the ply edges overlap because the overlap region creates a bump that is undesirable. Each ply 14 has adhesive applied to at least one of its surfaces (the first ply wound onto the mandrel being free of adhesive on its surface that contacts the mandrel) by a suitable adhesive applicator (not shown) located between the supply roll (not shown) for the ply and the mandrel. Thus, as each ply is wound onto the ply previously wound onto the mandrel, the plies are adhered together by the adhesive, thereby forming a continuous paperboard tube 12 on the mandrel. The apparatus includes a helical winding belt 32 that engages the tube 12 and advances it along the mandrel in screw fashion, at a pitch corresponding to the winding angle $\alpha$.

Unlike a conventional spiral winding process, the process shown in FIG. 5 includes the provision of a sandpaper strip 20 that is narrower than the plies 14. The strip 20 has adhesive applied to its back side by a suitable adhesive applicator 34, and the strip is then wound onto the outer surface of the paperboard tube 12 at the same winding angle as the plies 14. In this manner, a continuous length of winding core 10 is formed on the mandrel. At a downstream cutting station (not shown), the core 10 is cut into desired lengths.

A winding core 10 alternatively can be formed by a convolute winding process in which a single strip of paperboard is convolutely wrapped around a cylindrical forming mandrel, in a manner similar to wrapping a cigarette paper. The strip has a width equal to the desired length of the core and a length calculated to provide a desired number of convolute turns about the forming mandrel, and thus a desired number of paperboard layers in the tube wall. Adhesive is applied to the strip so that the layers are adhered together. The sandpaper strip 20 with adhesive applied thereto can then be spirally wound about the resulting tube in any desired manner.

As shown in FIG. 1, the winding core 10 is characterized by the sandpaper strip 20 extending about the outer surface 16 of the tube 12 for more than one full helical turn over the length of the core. In order to ensure that an end of a fabric to be wound about the core 10 will be snagged by the strip 20 simultaneously at multiple locations across the width of the fabric, the strip 20 should extend for at least two full helical turns over the core length. A winding core 110 having two helical turns of the strip 20 is shown in FIG. 2. More particularly, it is desirable for the strip to extend for at least three full helical turns, and even more particularly for at least four full helical turns over the core length, as shown for the winding core 10 of FIG. 1.

The objective of ensuring that the fabric to be wound about the core will be snagged simultaneously at multiple locations across the width of the fabric can be accomplished without using the spirally wound sandpaper strip 20. For example, a winding core in accordance with the invention can have discrete regions of grit bound in an adhesive binder, the regions being affixed to the outer surface of the tube and being sized and arranged such that the regions collectively occupy a minority of the total surface area of the outer surface. The regions further can be arranged such that there are at least two, more particularly at least three, and still more particularly at least four of the regions axially spaced apart along a length of the tube in positions to simultaneously encounter and snag an end of a fabric web to be wound about the core.

A winding core 210 in accordance with such an embodiment is shown in FIG. 4. The core 210 comprises a wound paperboard tube 212 having a generally cylindrical outer surface 216. Affixed to the outer surface 216 are a plurality of discrete spots or regions 220 of grit bound in an adhesive material applied to the outer surface. The regions 220 are spaced apart on the outer surface 216 and are arranged such that for at least one axial line extending along the outer surface 216, the line will intersect at least two regions 220, more preferably at least three regions, and still more preferably at least four regions. Advantageously, there are a plurality of such axial lines about the core circumference that will intersect at least two, at least three, or at least four of the regions. The core 210 can be formed by first forming the paperboard tube 212 as previously described, and then applying discrete regions of adhesive to the outer surface 216 in any suitable manner (e.g., by a patterned gravure roll, a spray applicator, or the like). While the adhesive remains tacky, grit can then be sprayed or otherwise brought into contact with the tacky adhesive regions so that the grit lodges in the adhesive and is bound therein when the adhesive dries or sets.

In use, a winding core 10, 110, 210 is installed in a winding device (not shown) and is rotated by the device about the axis of the core while a continuous length of fabric is advanced toward the rotating core and is brought into engagement with the outer surface of the core. The fabric is snagged by the grit regions 20, 220. Alternatively, the core can be stationary when the fabric is first engaged with the grit regions, and then the core can begin to rotate to wind the fabric about the core. In either case, because of the arrangement of the grit regions, they snag the fabric at two or more locations spaced apart across the width of the fabric, and thus help ensure that the fabric begins to wind about the core in a desired manner.

As noted, winding cores in accordance with the invention can be formed by spiral winding as illustrated in FIG. 5. When the core is long in relation to its inside diameter, the beam strength of the core can become an important consideration because there may be times during transport of a roll of fabric from one location to another when the roll may be supported in a manner that results in significant bending loads on the core. For applications requiring a high beam-strength core, the core can be formed as a "wide-ply" core in which the paperboard plies forming the core have a large width in relation to the inside diameter of the core, and thus are wound at a low winding angle α so that the machine direction of the paperboard is closer to axial than is the case for non-wide-ply cores. The strength of paperboard in the machine direction is typically higher than the cross-machine direction strength. Accordingly, a wide-ply core can have a higher beam strength than an otherwise equivalent non-wide-ply core. By "wide-ply core" is meant a core in which the width of the innermost paperboard ply is at least about three times the inside diameter of the core. Thus, for example, a wide-ply core having an ID of 3 inches will have an innermost paperboard ply that is at least about 9 inches wide.

EXAMPLE 1

Winding cores were prepared from paperboard tubes having an inside diameter of 4 inches, a wall thickness of 0.30 inch, and a length of 181 inches. A 1-inch wide strip of 120 grit sandpaper with adhesive applied to its back side was helically wound about each of the tubes to form the winding cores. During evaluation testing, the cores performed well in start-up of winding of a nonwoven fabric about the cores.

EXAMPLE 2

Cores were prepared as in Example 1, except that the sandpaper was a much coarser 80 grit paper. The cores were subjected to the same type of evaluation testing as for Example 1, and performed equally as well as the cores of Example 1.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A winding core for fabrics facilitating the gripping and start-up of winding of a fabric web about the core, comprising:

a wound paperboard tube comprising a plurality of paperboard layers wound one upon another about an axis of the tube and adhered together, the tube having a generally cylindrical outer surface having a total surface area; and regions of grit bound in an adhesive binder, said regions being affixed to the outer surface of the tube and being sized and arranged such that said regions collectively occupy a minority of the total surface area of the outer surface, said regions further being arranged such that there are at least two of said regions axially spaced apart along a length of the tube in positions to simultaneously encounter and snag an end of a fabric web to be wound about the core.

2. The winding core of claim 1, wherein said regions are arranged such that there are at least three of said regions axially spaced apart along the length of the tube are in positions to simultaneously encounter and snag the end of the fabric web.

3. The winding core of claim 1, wherein said regions are arranged such that there are at least four of said regions axially spaced apart along the length of the tube are in positions to simultaneously encounter and snag the end of the fabric web.

4. The winding core of claim 1, wherein said regions are arranged such that there is at least one axial line extending the length of the tube along the outer surface that intersects at least two of said regions.

5. The winding core of claim 1, wherein said regions are arranged such that there is at least one axial line extending the length of the tube along the outer surface that intersects at least three of said regions.

6. The winding core of claim 1, wherein said regions are arranged such that there is at least one axial line extending the length of the tube along the outer surface that intersects at least four of said regions.

7. The winding core of claim 1, wherein said regions comprise a strip extending helically about the outer surface of the tube.

8. The winding core of claim 7, wherein the strip is continuous and extends at least two helical turns about the outer surface over the length of the tube.

9. The winding core of claim 8, wherein the strip extends at least three helical turns over the length of the tube.

10. The winding core of claim 8, wherein the strip extends at least four helical turns over the length of the tube.

11. The winding core of claim 8, wherein the strip is formed by a piece of sandpaper affixed to the outer surface of the tube.

12. The winding core of claim 1, wherein said regions comprise discrete spots spaced apart on the outer surface of the tube.

13. The winding core of claim 1, wherein the paperboard tube is spirally wound from a plurality of paperboard plies, and wherein an innermost one of the paperboard plies has a width that is at least about three times an inside diameter of the paperboard tube.

14. The winding core of claim 13, wherein the winding core has a length of about 50 inches to 250 inches, and the inside diameter is from about 1 inch to about 6 inches.

* * * * *